US005418337A

United States Patent [19]

Schreiber

[11] Patent Number: 5,418,337

[45] Date of Patent: May 23, 1995

[54] LOUDSPEAKER DRIVER SURROUNDING

[75] Inventor: William P. Schreiber, Ashland, Mass.

[73] Assignee: Bose Corporation, Framington, Mass.

[21] Appl. No.: 69,300

[22] Filed: May 28, 1993

[51] Int. Cl.[6] ..... G10K 13/00

[52] U.S. Cl. ..... 181/171; 181/173

[58] Field of Search ..... 181/171, 172, 173, 174, 181/170, 166, 164, 165

[56] References Cited

U.S. PATENT DOCUMENTS

| | | | |
|---|---|---|---|
| 01,630,008 | 5/1927 | Hopkins . | |
| 2,860,721 | 11/1958 | Hassan | 181/171 |
| 3,072,213 | 1/1963 | Petrie | 181/171 |
| 3,285,364 | 11/1966 | Cohen | 181/166 |
| 4,100,992 | 7/1978 | Rehde et al. . | |

FOREIGN PATENT DOCUMENTS

| | | |
|---|---|---|
| 0492914A2 | 7/1992 | European Pat. Off. . |
| 18355 | 3/1922 | United Kingdom . |
| WO92/01359 | 1/1992 | WIPO . |

OTHER PUBLICATIONS

European Search Report on Application No. 94303190.6 dated Sep. 19, 1994.

*Primary Examiner*—M. E. Gellner
*Assistant Examiner*—Khanh Dang
*Attorney, Agent, or Firm*—Fish & Richardson

[57] ABSTRACT

A loudspeaker diaphragm has a surround comprising vibratile material extending between an inner circle and an outer circle. The material has a thin compliant roll near the outer circle and an outer circular bead inside of and near the thin compliant roll. An inner ridge having both radial and tangential components extends between the inner circle and the outer circular bead. The width of the outer circular bead and the inner ridge is significantly less than the diameter of the outer circle. The attachment area between the cone body and the surround covers a substantial area of the cone body.

16 Claims, 4 Drawing Sheets

LOUDSPEAKER DRIVER SURROUNDING

The present invention relates in general to loudspeader driver surrounding and more particularly concerns novel structure and techniques for improving loudspeaker driver performance with a novel surround shape which overlaps the diaphragm over much of its surface area.

An important goal of loudspeaker designers has been to provide a single loudspeaker driver characterized by substantially uniform acoustical energy output as a function of frequency over substantially the full frequency range. One prior art approach involved attaching a high compliance roll at the edge of a rigid cone body to improve the low frequency response. This approach not only does not correct irregularities in the high frequency response, but may even exacerbate mid-range anomalies. Another approach uses driver cone materials of increased stiffness (modulus of elasticity) to increase high frequency output, but with increased irregularity in response.

It is an important object of the invention to provide a practically manufacturable driver characterized by a substantially uniform frequency response over a wide range of audio frequencies.

It is known that increasing the driver motor strength $(BL)^2/RE$, where B=motor gap magnetic field strength, L=length of voice coil wire in that gap, $R_E$=resistance of voice coil, increases the acoustical output of spectral components in the middle range of audio frequencies relative to the bass frequencies. Adding mass to the cone of a driver with high motor strength according to the invention reduces the mid-range response to substantially the level of the bass response and extends the fundamental mass-compliance resonance of the system to lower bass frequencies. In embodiments of the invention, this mass is typically two to five times greater than that of a prior art driver. According to another aspect of the invention, damping material is comolded with the flexible part of the surround from a material that has suitable flexibility and internal damping properties, this damping material being at the junction of the surround roll and cone body. According to still another feature of the invention, material with appropriate mass and damping factor is attached at appropriate locations on the surface of the cone body to achieve smooth extended high-frequency power response.

In a specific form of the invention adding mass, providing an edge damping ring and distributing damping material over the surface of the cone in a single molded elastomeric surround which is laminated to the cone body over a substantial portion of the cone area produces a driver characterized by a substantially uniform power response as a function of frequency over a broad range of audio frequencies.

According to the invention, a loudspeaker driver diaphragm comprises a cone body laminated to a driver surround over most of its sound radiating area. This surround is characterized by increased mass along a predetermined path of width significantly less than the cone body diameter and having both a radial and tangential component. The path is typically symmetrical about the cone body axis and may comprise a plurality of contiguous segments, typically extending between an inner circle of diameter corresponding substantially to that of a loudspeaker dust cap and the high compliance surround roll near the edge of the cone body, typically generally in the shape of the periphery of a multi-petalled flower. Preferably, the mass is also increased in a circular region just inside the edge of the compliant surround roll.

Numerous other features, objects and advantages of the invention will become apparent from the following detailed description when read in connection with the accompanying drawings in which.

Figure 7:
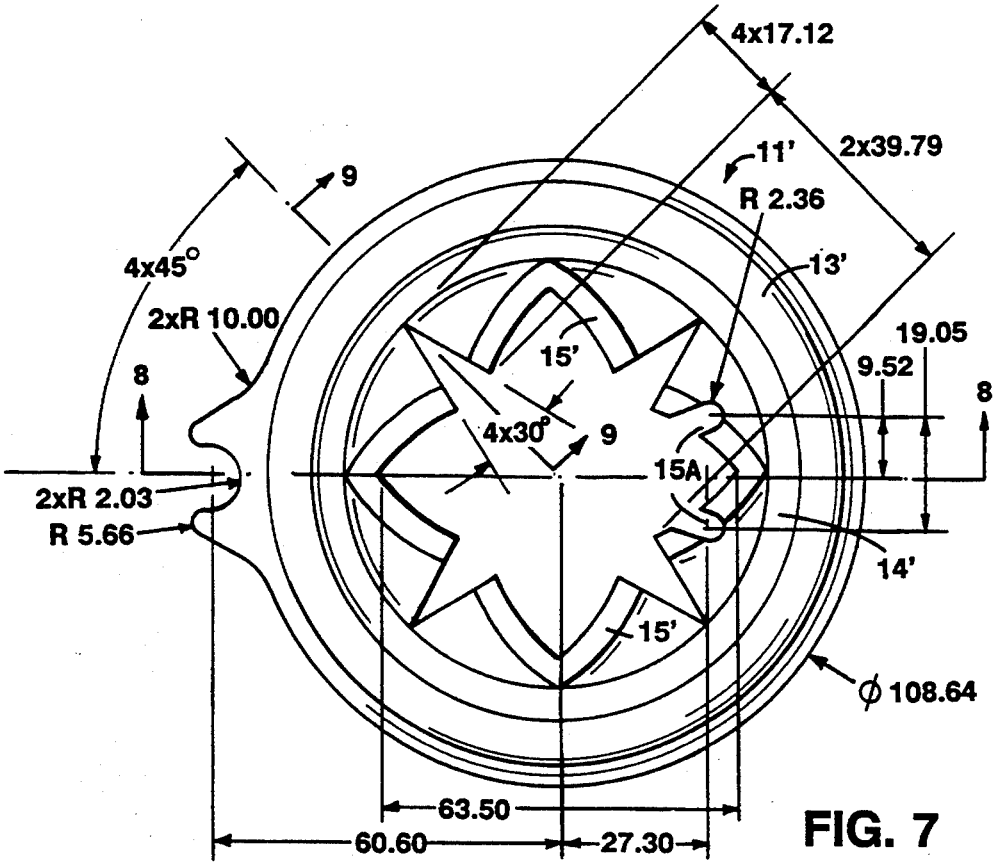
FIG. 7 is a plan view of a commercial embodiment of a surround according to the invention.
Figure 8:
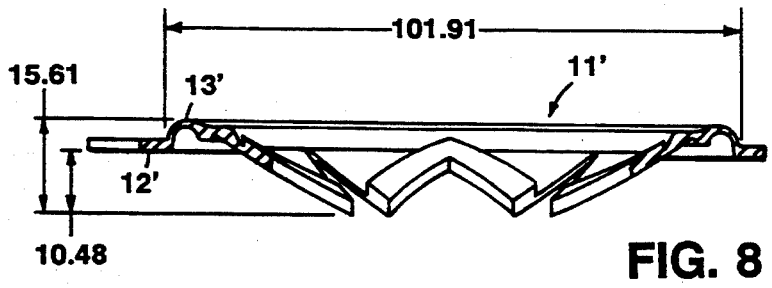
Figure 9:
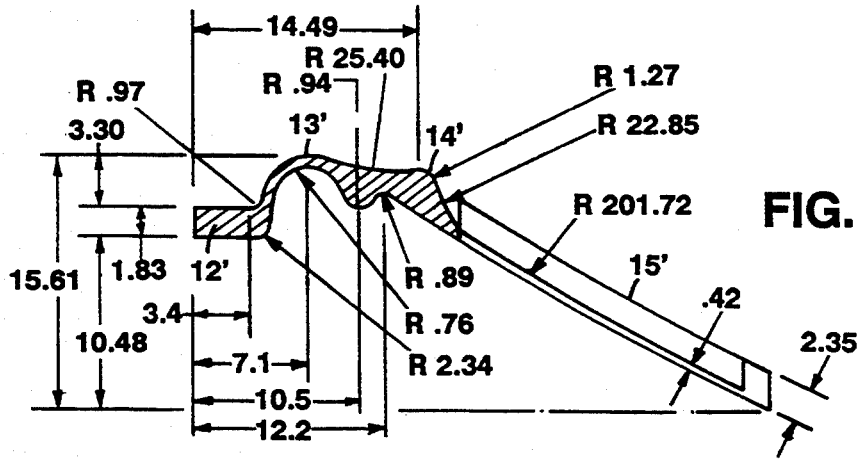
Figure 10:
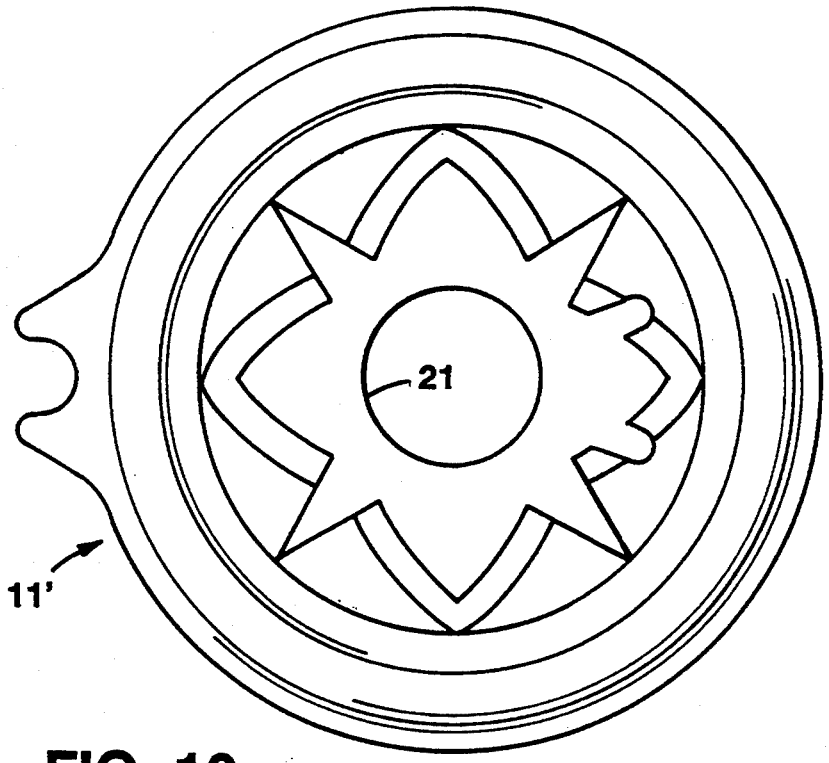

FIGS. 8 and 9 are sectional views through sections 8—8 and 9—9 of FIG. 7; and FIG. 10 is a plan view of the surround of FIG. 7–9 attached to stiff cone material according to the invention.

Figure 1:
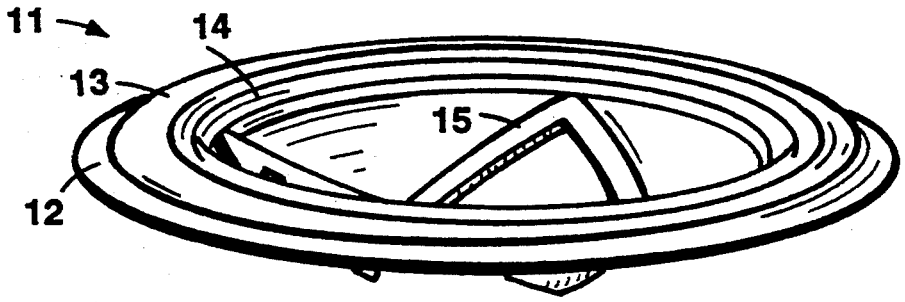
FIG. 1 is a perspective view of a surround according to the invention.
Figure 2:
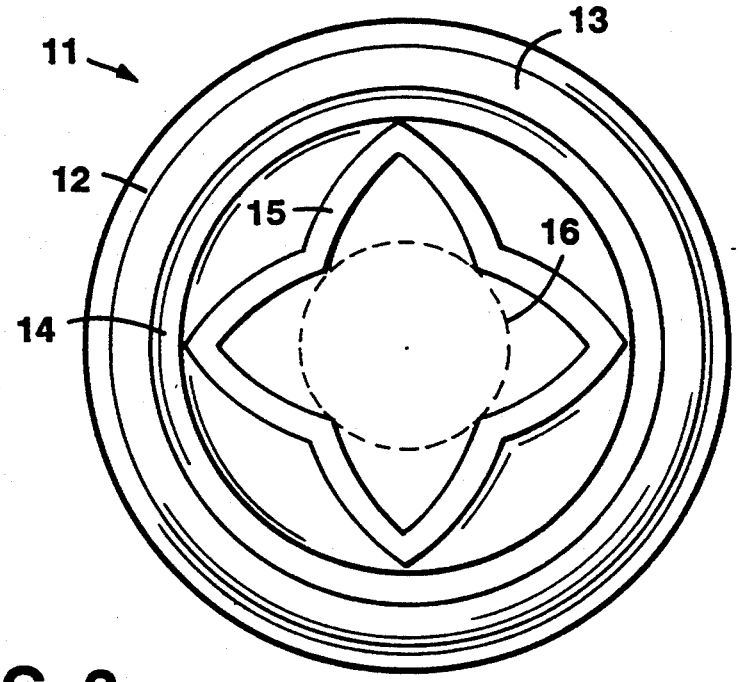
FIG. 2 is a plan view of the surround of FIG. 1.
Figure 3:
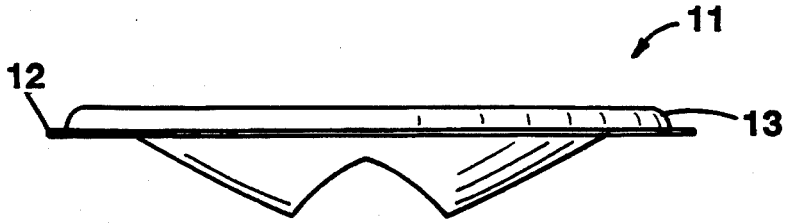
FIG. 3 is an elevational view of the diaphragm of FIG. 1.

With reference now to the drawings and more particularly FIGS. 1, 2 and 3 thereof, there are shown perspective, plan and elevational views, respectively, of an exemplary surround according to the invention. Surround 11 has at the outer edge a conventional semi-toroidal thin roll 13 just inside an outer circle enclosing surround 11 about the surround axis in the region that is the typical compliant element of a cone assembly. There is also an outer circular bead 14. A generally clover-shaped inner ridge 15 extends between circular bead 14 and an inner circle 16 corresponding substantially to the location of a dust cap. Ridge 15 comprises a number of contiguous segments each extending between inner circle 16 concentric with the outer circle about the surround axis and bead 14. The inner ridge 15 thus occupies a path that may be resolved into radial components extending along radii of the inner and outer circles and tangential components extending along directions perpendicular to the radii. The width of clover-shaped ridge 15 and bead 14 is significantly less than the diameter of the outer circle enclosing surround 11, each width being of the order of the same magnitude.

The structural modifications to a conventional surround described above help smooth out the middle and upper frequency response of a driver with this surround. The effect of ridge 15 and bead 14 is to increase the mass and density factor along the indicated path to help dampen resonances in both radial and tangential vibrational modes which are inherent in all cones operating at frequencies where the wavelength of sound is in the cone material smaller than the diameter of the cone.

It is within the principles of the invention to add material to a conventional diaphragm in the indicated pattern, or in a similar axi-symmetric pattern with 4 or more lobes, which inner ridge is generally in the shape of the periphery of a multi-petalled flower. Preferably, the surround is molded in the indicated pattern.

Figure 4:
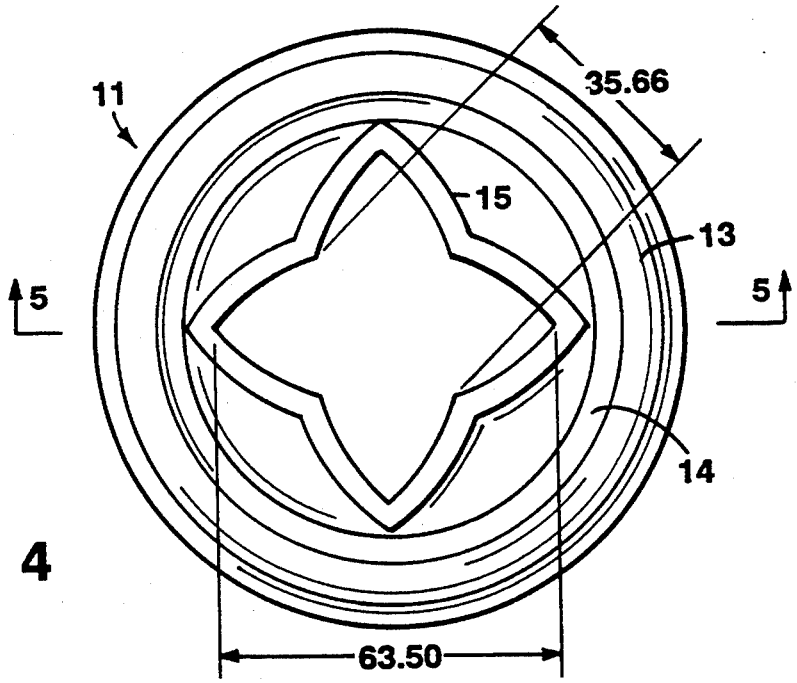
FIG. 4 is a plan view of the diaphragm showing typical dimensions.
Figure 5:
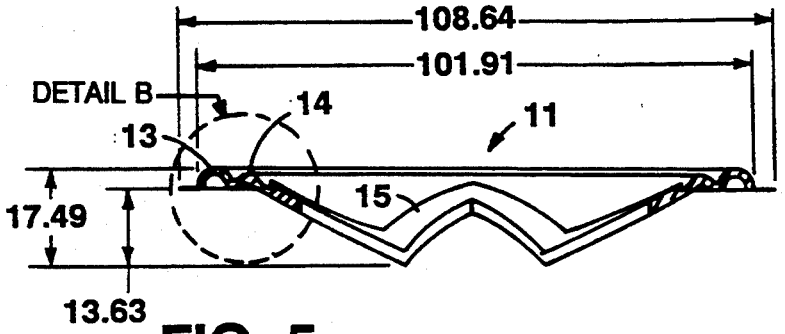
FIG. 5 is a sectional view through section 5—5 of FIG. 4.
Figure 6:
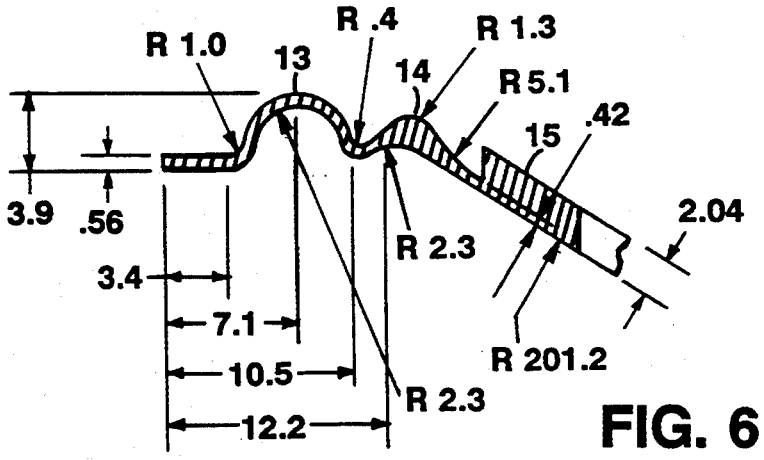
FIG. 6 is an enlarged sectional fragmentary view along a radius of the surround illustrating structural features.

Referring to FIG. 4, there is shown a plan view of an exemplary embodiment with actual dimensions in millimeters indicated. Referring to FIG. 5, there is shown a sectional view through section 5—5 of FIG. 4 with dimensions indicated in millimeters. Referring to FIG. 6, there is shown an enlarged sectional view corresponding to detail B in FIG. 5 with actual dimensions indicated in millimeters.

One of the materials with suitable density and loss parameters for the surround is SBR rubber having Share A hardness of 50, rebound resilience of 38% per DIN 53-512, and density of 1.16 gr/cm.$^3$ so that the weight of surround roll 13 is typically 1 gram, bead 14 is 4 grams and ridge 15 is 2 grams.

Referring to FIG. 7, there is shown a plan view with specific dimensions in millimeters and degrees of a commercial embodiment of the invention. Referring to FIG. 8, there is shown a sectional view through section 8—8 of FIG. 7. Referring to FIG. 9, there is shown a sectional view through section 9—9 of FIG. 7. Elements in FIGS. 7–9 which correspond to elements in FIGS. 4–6, respectively, are identified by the same reference numeral with an appended '.

The embodiment of FIGS. 7–9 are formed with rounded cutouts 15A for accommodating flexible leads from the loudspeaker driver voice coil dressed along the stiff cone portion for connection to leads connected to the rear side of the stiff cone portion to which the surround 11 is attached in the usual manner.

Referring to FIG. 10, extending between an inner cone body circle and an outer cone body circle there is shown a plan view of the surround of FIGS. 7–9 attached to the stiff cone body 21.

Appendix A is an embodiment of FIGS. 7–10.

The invention may be embodied in other forms. For example, weights may be attached to a diaphragm following the principles of the invention. Beads of silicon or other material may be attached to a conventional diaphragm.

It is evident that those skilled in the art may make numerous other uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A loudspeaker diaphragm having a surround and cone body attached to the surround over an attachment area and characterized by an axis comprising, elastomeric material extending between an inner circle and an outer circle concentric about said axis, said material having a thin compliant roll near said outer circle, said material having an outer circular bead inside of and near said thin compliant roll, and an inner ridge occupying a path having both radial components extending along radii of the inner and outer circle and tangential components extending along directions perpendicular to said radii, said inner ridge being between said inner circle and said outer circular bead, the width of said outer circular bead and said inner ridge being significantly less than the diameter of said outer circle, the attachment area between the cone body and the surround covering a substantial area of the cone body.

2. A loudspeaker diaphragm in accordance with claim 1 wherein the width of said outer circular bead is of the order of the width of said inner ridge.

3. A loudspeaker diaphragm in accordance with claim 1 wherein said inner ridge defines a pattern symmetrical about said axis.

4. A loudspeaker diaphragm in accordance with claim 3 wherein said pattern is substantially that of the periphery of a multi-petalled flower.

5. A loudspeaker diaphragm in accordance with claim 4 wherein said pattern has four leaves in space quadrature about said axis.

6. A loudspeaker diaphragm in accordance with claim 4 in which said pattern has eight leaves equally spaced about said axis.

7. A loudspeaker diaphragm comprising, stiff cone material filling substantially the entire area between an inner circle and an outer circle, and a surround of stiffness significantly less than that of said stiff cone material attached to said cone material over an area that is a substantial portion of said entire area.

8. A loudspeaker diaphragm in accordance with claim 7 wherein said substantial portion is at least half said entire area.

9. A loudspeaker diaphragm in accordance with claim 1 wherein said cone body extends between said inner circle and said outer circle filling substantially the entire area between said inner circle and said outer circle, and said surround is of stiffness significantly less than that of said cone body and is attached to said cone body over an area that is a substantial portion of said entire area between said inner circle and said outer circle.

10. A loudspeaker diaphragm in accordance with claim 9 wherein said substantial portion is at least half said entire area between said inner circle and said outer circle.

11. A loudspeaker diaphragm surround for attachment to a cone body and characterized by an axis comprising, elastomeric material extending between an inner circle and an outer circle concentric about said axis, said material having a thin compliant roll near said outer circle, said material having an outer circular bead inside of and near said compliant roll, and an inner ridge occupying a path having both radial components extending along radii of the inner and outer circles and tangential components extending along directions perpendicular to said radii between said inner circle and said outer circular bead, the width of said outer circular bead and said inner ridge being significantly less than the diameter of said outer circle.

12. A loudspeaker diaphragm surround in accordance with claim 11 wherein the width of said outer circular bead is of the order of the width of said inner ridge.

13. A loudspeaker surround in accordance with claim 11 wherein said inner ridge defines a pattern symmetrical about said axis.

14. A loudspeaker surround in accordance with claim 13 wherein said pattern is substantially that of the periphery of a multi-petal flower.

15. A loudspeaker surround in accordance with claim 14 wherein said pattern has four leaves in space quadrature about said axis.

16. A loudspeaker surround in accordance with claim 14 wherein said pattern has eight leaves equally spaced about said axis.

* * * * *

UNITED STATES PATENT AND TRADEMARK OFFICE

CERTIFICATE OF CORRECTION

PATENT NO. : 5,418,337

DATED : May 23, 1995

INVENTOR(S) : William P. Schreiber

It is certified that error appears in the above-identified patent and that said Letters Patent is hereby corrected as shown below:

On the cover page, left column, last line, "3/1922" should read --3/1911--.

Column 1, lines 4-5, "loudspeader" should read --loudspeaker--.

Line 28, "RE" should read --$R_E$--.

Column 3, lines 26-29, "extending between an inner cone body circle and an outer cone body circle there is shown a plan view of the surround of FIGS. 7-9 attached to the stiff cone body 21." should read --there is shown a plan view of the surround of FIGS. 7-9 attached to the stiff cone body 21 extending between an inner cone body circle and an outer cone body circle.--.

Signed and Sealed this

First Day of October, 1996

Bruce Lehman

*Attest:*

BRUCE LEHMAN

*Attesting Officer*

*Commissioner of Patents and Trademarks*